US005195262A

United States Patent [19]

Roane

[11] Patent Number: 5,195,262

[45] Date of Patent: Mar. 23, 1993

[54] CALENDAR

[76] Inventor: James F. Roane, Rt. 2, Box 1647, Beaumont, Tex. 77705

[21] Appl. No.: 882,942

[22] Filed: May 14, 1992

[51] Int. Cl.[5] ..... G09D 3/04

[52] U.S. Cl. ..... 40/109; 40/119

[58] Field of Search ..... 40/107, 109, 119, 122, 40/488, 490; 283/2

[56] References Cited

U.S. PATENT DOCUMENTS

| | | | |
|---|---|---|---|
| 1,373,744 | 4/1921 | Kelly | 40/109 |
| 2,499,329 | 2/1950 | Potter | 40/109 |
| 4,221,064 | 9/1980 | Sebastian | 40/109 |
| 5,123,191 | 6/1992 | Kim | 283/2 X |

FOREIGN PATENT DOCUMENTS

| | | | |
|---|---|---|---|
| 1256470 | 6/1989 | Canada | 283/2 |

*Primary Examiner*—Kenneth J. Dorner
*Assistant Examiner*—Brian K. Green
*Attorney, Agent, or Firm*—Dodge, Bush, Moseley & Riddle

[57] ABSTRACT

A calender (10) has a plurality of leaves (12) each representing a month of a year. Each leaf (12) has an outer transparent cover forming a pocket for inner and outer sheets (24,26). Inner sheet (26) has numerals therein in a precise pattern which are registered with apertures (30) in the outer sheet (24) to represent the days of the month. Inner sheet (26) has seven columns of numerals and is slidable a maximum distance no greater than the width of one column in order to adapt calendar (10) for all years.

7 Claims, 2 Drawing Sheets

CALENDAR

FIELD OF THE INVENTION

This invention relates to calendars, and more particularly to a calendar which includes an inner slidable sheet for each month and containing numerals which may be selectively registered to represent days of the month for viewing to provide a single calendar usable for multiple years.

BACKGROUND OF THE INVENTION

Heretofore, calendars have been provided utilizing an inner slidable sheet or member containing numerals for registering with selective openings in an outer sheet to provide a single calendar which may be used year after year with certain manual adjustments. For example, U.S. Pat. No. 2,499,329 dated Feb. 28, 1950 is directed to a calendar having an outer relatively fixed sheet or cover with cutout portions or apertures therein for registering with numerals representing each day of a month and an inner slidable sheet containing the predetermined numerals thereon for registering with the apertures on the outer sheet for viewing to indicate the day of the month. In addition, the days of the week are shown on the inner slidable sheet or card for registering with the apertures. In order to use the calendar in U.S. Pat. No. 2,499,329 for an entire month it is necessary to remove the inner slidable card from the outer cover, and then reverse the inner card for reinsertion within the outer cover. As the days of the weeks are set forth on the inner slidable card, the days of the week cannot be printed in a fixed relation on the outer cover sheet.

U.S. Pat. No. 2,609,630 dated Sep. 9, 1952 also shows a calendar having an inner slidable card with numerals thereon for registering with a single large opening or aperture in the outer cover for viewing. The inner slidable card does not require removal and reversal for registering with the outer cover but does require a large width in which to present the various days of the month. As shown in the drawings of the '630 patent the inner card projects laterally outside of the outer cover a substantial distance in order to indicate certain days of a month. It is undesirable to require such a large width in order to operate and a viewing of a portion of the inner card extending outside the cover is not desirable.

SUMMARY OF THE INVENTION

The present invention is directed to a calendar usable year after year and including an inner slidable sheet or card which is movable a minimal lateral distance to represent the days of a month and does not require removal or reversal of the card relative to the outer cover. The outer cover or sheet has eight columns thereon of the same width with seven columns denoting the seven days of a week and the last column having space and suitable indicia thereon for jotting down certain monthly dates to be remembered. The width of each column is sufficient to include numerals representing seven days and thus, the inner slidable card or sheet is required to be moved laterally only the width of one column in order for the inner card to represent all of the days of a month. Each of the apertures or cutout portions in the outer sheet for the days of a month is of a width generally equal to one seventh the width of a column so that only the numeral representing the day of the month is aligned with the aperture and viewable.

The calendar of the present invention includes a separate leaf for each month with each leaf including a transparent outer cover which receives the outer sheet and the slidable inner sheet. The outer sheet has eight columns and five rows and the inner sheet has numerals thereon which are selectively aligned or registered with apertures in the outer sheet. If desired, an additional leaf may be added providing a listing of the first day of each month for a predetermined number of future years.

It is an object of this invention to provide a calendar having a separate leaf for each month with each leaf having an inner slidable sheet containing numerals presenting the various days of the month for viewing and movable each year, to present different monthly days thereby to provide a single calendar usable for all years.

It is a further object of this invention to provide such a calendar having a separate column on each monthly leaf for writing notes or dates thereon to be remembered.

It is another object to provide such a calendar in which an outer sheet has eight columns including a column for each day of the week and the inner sheet containing numerals for each day of the month is movable a maximum distance not greater than the width of a column to provide a calendar suitable for all years.

Other objects, features, and advantages of this invention will become more apparent after referring to the following specification and drawings.

DESCRIPTION OF THE INVENTION

Figure 1:
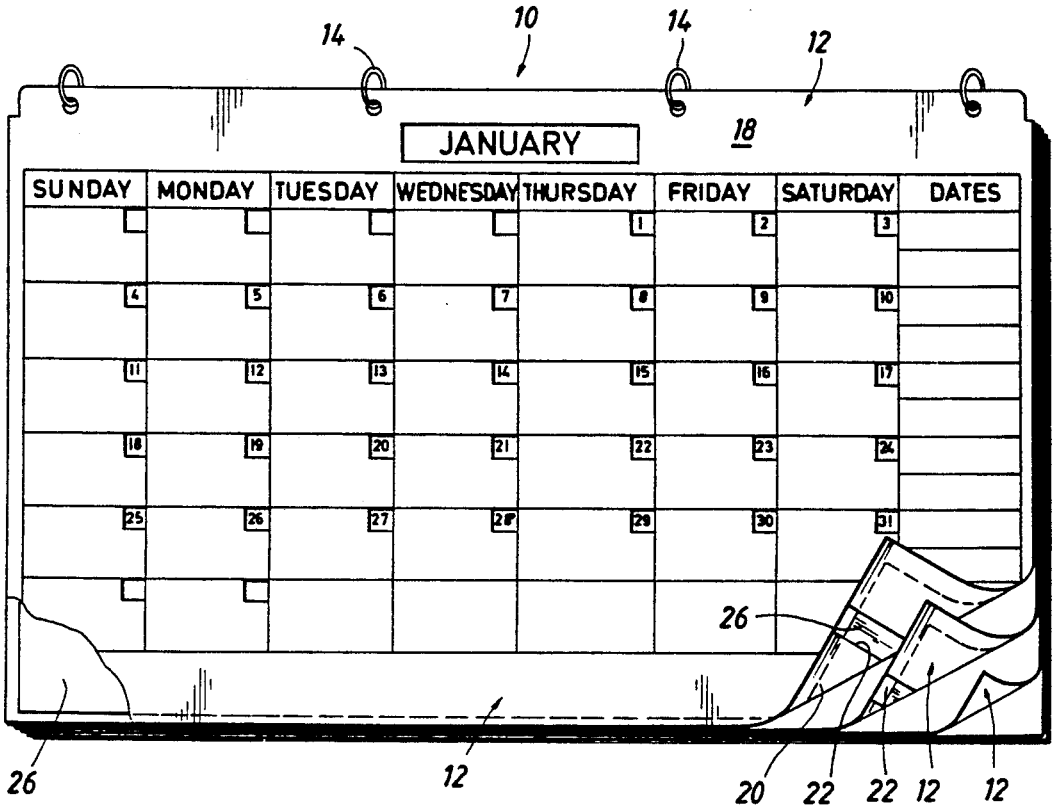
FIG. 1 is a perspective of a calendar in accord with the present invention and showing a plurality of leaves representing twelve months and illustrating each leaf as including an outer transparent cover, an outer sheet with apertures therein, and an inner slidable sheet with numerals therein for registering with the apertures.
Figure 2:
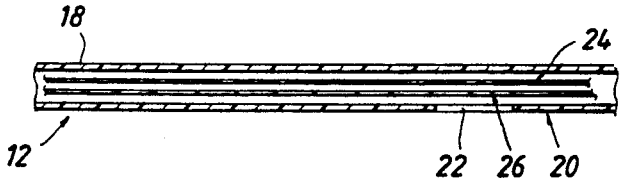
FIG. 2 is a section of a leaf showing the outer cover and sheets and a slot to permit insertion of the sheets within the outer cover.

Referring now to the drawings for a better understanding of this invention, and more particularly to FIG. 1, a calendar is shown generally at 10 including a plurality of leaves 12 connected together by a plurality of rings 14. At least twelve leaves 12 are provided with a particular month of the year represented by a leaf. Additional leaves 12 may be provided, if desired, to contain specific information such as dates and events to be remembered, for example. Each of leaves 12 representing a month is generally similar but somewhat different for months having a different number of days in the month, such as February, for example. For the purposes of illustration, leaf 12 representing January is illustrated in the drawings, it being understood that the remaining leaves 12 representing the other months are generally similar except for the number of days in the month as will be explained further.

Each leaf 12 has an outer transparent cover, preferably formed of polyethylene, including a front side 18 and a rear side 20 heat sealed together along their edges to form a pocket therebetween. A slot 22 is formed in rear side 20 to permit the entry within the pocket of an outer sheet generally indicated at 24 and an inner slidable sheet generally indicated at 26. After outer sheet 24 is inserted within the pocket from slot 22, sheet 24 is not removed and remains in place. Thereafter slidable sheet 26 is inserted within the pocket through slot 22 and thereafter is required to be moved only once annually in order to present the appropriate days of the month for viewing.

Figure 4:
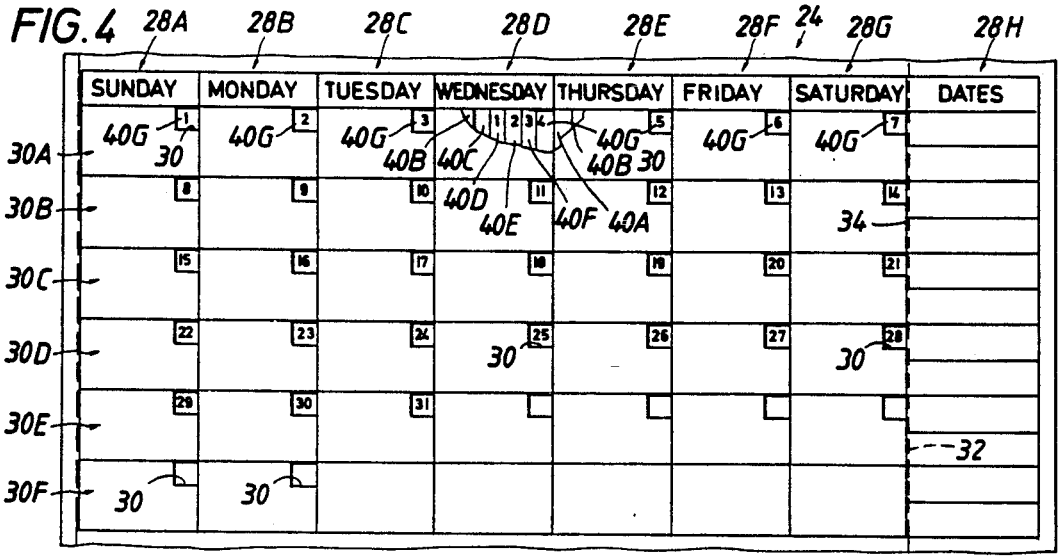
FIG. 4 is a front view of a leaf of the calendar for January with the inner sheet in its leftmost position for showing Sunday as January 1.
Figure 5:
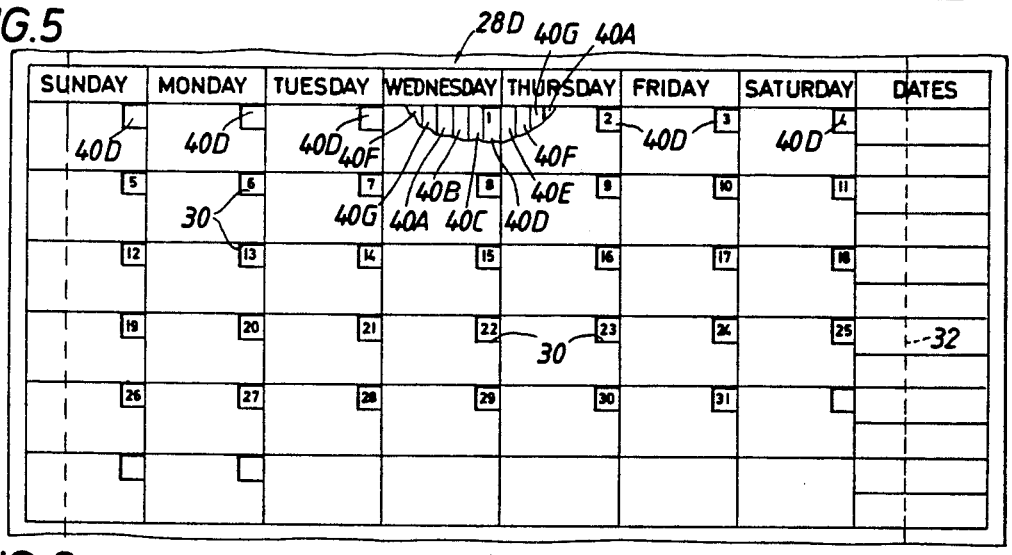
FIG. 5 is a front view of the leaf shown in FIG. 4 with the inner sheet is an intermediate position showing Wednesday as January 1.
Figure 6:
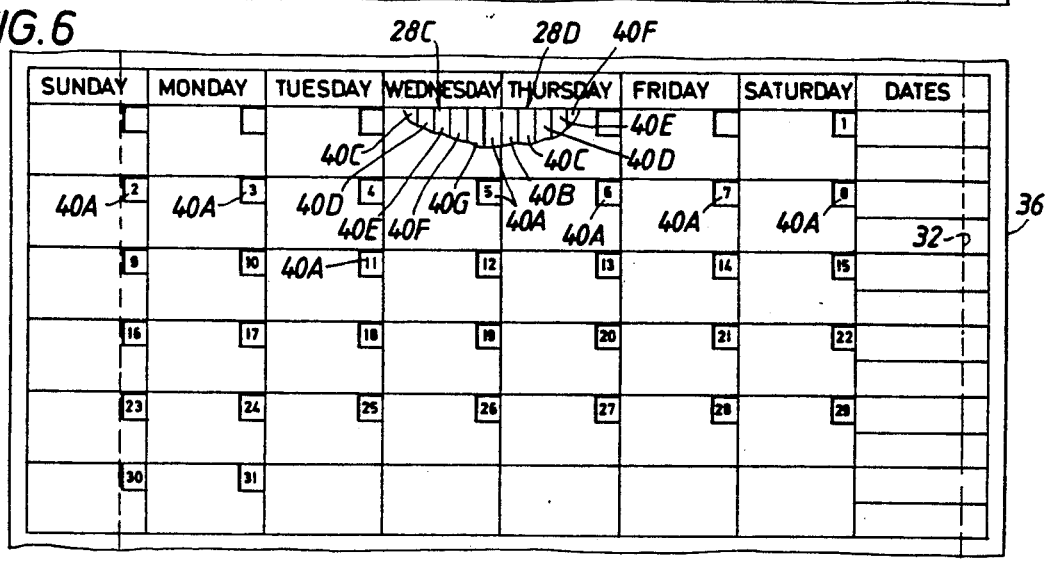
FIG. 6 is a front view of the leaf shown in FIGS. 4 and 5 with the inner sheet in its rightmost position showing Saturday as January 1.

Referring now to FIGS. 4–6, outer rectangular sheet 24 for January is illustrated and includes eight columns 28A, 28B, 28C, 28D, 28E, 28F, 28G and 28H. Each column 28A to 28H is of the same width with each of columns 28A–28G representing a day of the week and column 28H being a column for writing down notes, such as dates or events to be remembered for the specific month. Sheet 24 has six rows 30A–30F.

Columns 28A–28G and rows 30A–30F form blocks with each block having an aperture or cutout portion 30 therein. For example, the block shown in FIG. 4 in column 28A and row 30A has an aperture 30 with the numeral 1 appearing therein for viewing while the block shown in column 28C and row 30E has the numeral 31 registering with aperture 30 for viewing. Aperture 30 is of a width no greater than one seventh of the width of a column to allow a minimum movement of inner slidable sheet 26 relative to outer sheet 24 when registering or aligning the desired monthly day with aperture 30. It is only necessary to have aperture 30 register with seven different numerals representing seven different monthly days and the maximum movement of slidable sheet 26 is the width of a column. The first day of January is shown as Sunday in FIG. 4, as Wednesday in FIG. 5, and as Saturday in FIG. 6. It is noted that sheet 26 is in its leftmost position in FIG. 4 has its outer right edge 32 aligned with the left edge 34 or margin of column 28H, and in its rightmost position in FIG. 6 with its outer right edge 32 adjacent the right edge or margin 36 of column 28H.

Figure 3:
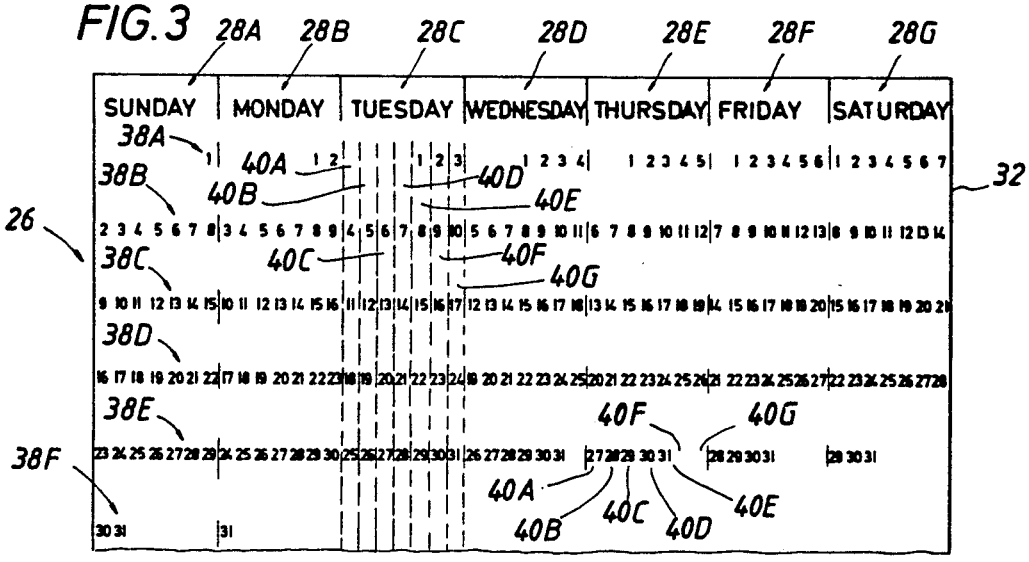
FIG. 3 is a front view of the inner slidable sheet removed from the calendar shown in FIG. 1 with the numerals thereon for each day of a month.

Referring to FIG. 3, inner sheet 26 is shown with the numerals arranged in a precise pattern thereon particularly for permitting registering of numerals representing monthly days of a specific month with apertures 30 for all years. The only adjustment required for one year to the next is the movement of inner sheet 26 to a position so that the first day of the month is registered with the correct day of the week. The remaining monthly days automatically align with the correct aperture with the alignment of the first day of the month. As shown on FIG. 3, six rows of numerals 38A, 38B, 38C, 38D, 38E, 38F are provided for respective rows 30A–30F on outer sheet 24. The first row 38A begins with numeral 1 in the rightmost position of column 28A and ends with numeral 1 in the leftmost position of column 28G. Numeral 1 progressively moves to the left with each column between column 28A and column 28G. Each column 28A–28G includes seven subcolumns 40A, 40B, 40C, 40D, 40E, 40F, 40G as illustrated in FIG. 3 particularly for columns 28C and 28E for example. Each subcolumn 40A–40G is of a width equal to the width of aperture 30 and may be blank, or have one or two numerals thereon. Each column for rows 38B, 38C, and 38D has seven subcolumns with each subcolumn having one or two numerals thereon while rows 38E and 38F have a progressively descending number of numerals thereon. The arrangement of numerals on inner sheet 26 is adequate for all months including months with only thirty days and February. However, in the event inner slidable sheet 26 is used for a thirty day month, such as April, June, September, and November, the numerals "31" are deleted or blocked out. For February, the numerals "30" and "31" are deleted and a note is provided on on the leaf for February that the numeral "29" should be disregarded or ignored if it is not a leap year.

Inner sheet 26 thus slides between the position shown in FIG. 4 and the position shown in FIG. 6 which is the width of a column. It is not necessary to remove inner sheet 26 or to turn inner sheet 26 in order to adapt sheet 26 for all years. Outer sheet 24 is of the width of eight columns with the last column including space for jotting or writing down notes on certain dates or events to be remembered, such as birthdays, trips, parties, anniversaries, and the like.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

I claim:

1. In a calendar having a separate leaf for each month; each leaf comprising:

an outer sheet having seven longitudinally extending parallel columns thereon of substantially the same transverse width with each column denoting a day of a week and having five parallel transverse rows thereby providing an area having thirty five generally rectangular blocks of a similar size therein with each block having a similar transverse width and adapted to represent a specific day of a month;

a cutout portion for each block being of a transverse width no greater than one seventh of the transverse width of a block;

an inner sheet having numerals on one side thereof for representing the days of a month and slidable relative to said outer sheet in a direction parallel to said rows with predetermined numerals registering with predetermined cutout portions in said blocks for visually showing the specific days of the month represented by said numerals; and means adjacent said inner sheet supporting said inner sheet for sliding movement relative to said outer sheet.

2. In a calendar as set forth in claim 1 wherein each of said blocks is of a transverse width sufficient to provide a space for at least seven numerals, and said inner sheet is slidable a maximum distance generally the same as the width of a block for presenting a selected one of said seven numerals for registering with the cutout portion in an associated block.

3. In a calendar as set forth in claim 2 wherein an additional column is provided on said outer sheet of a width generally the same as the width of one of said seven columns and said inner sheet is adapted to slide selectively back and forth along the width of said additional column.

4. In a calendar as set forth in claim 3 wherein said additional column has lines thereon extending in a direction parallel to the width of said additional column and adapted to receive written information thereon.

5. A leaf for a calendar representing a month of a year, said leaf comprising:

an outer sheet having seven longitudinally extending parallel columns thereon of substantially the same transverse width with each column denoting a day of a week and having five parallel transverse rows thereby providing an area having thirty five generally rectangular blocks of a similar size therein with each block having a similar transverse width and adapted to represent a specific day of the month;

a cutout portion for each block being of a width no greater than one seventh of the transverse width of a block;

an inner sheet having numerals on one side thereof for representing the days of a month and slidable relative to said outer sheet in a direction parallel to said rows with predetermined numerals registering with predetermined cutout portions in said blocks for visually showing the specific days of the month represented by said numerals; and means adjacent said inner sheet supporting said inner sheet for sliding movement relative to said outer sheet.

6. A leaf as set forth in claim 5 wherein each of said blocks is of a width sufficient to provide a space for at least seven numerals, and said inner sheet is slidable a maximum distance generally the same as the width of a block for presenting a selected one of said seven numerals for registering with the cutout portion in an associated block.

7. A leaf as set forth in claim 6 including an outer transparent cover for said sheets having front and rear sides forming a pocket to receive said sheets.

* * * * *